US005427011A

United States Patent [19]

Steinberger

[11] Patent Number: 5,427,011

[45] Date of Patent: Jun. 27, 1995

[54] CHROMATIC TUNER DISPLAY

[76] Inventor: Ned Steinberger, 153B Jackson Ave., New Windsor, N.Y. 12550

[21] Appl. No.: 251,632

[22] Filed: May 31, 1994

Related U.S. Application Data

[63] Continuation of Ser. No. 966,391, Oct. 26, 1992, abandoned.

[51] Int. Cl.[6] ..... G10G 7/02

[52] U.S. Cl. ..... 84/454; 84/DIG. 18; 362/29

[58] Field of Search ..... 84/454, 455, 456, DIG. 18; 116/220, 28.1; 362/29, 30

[56] References Cited

U.S. PATENT DOCUMENTS

| | | | |
|---|---|---|---|
| 2,958,250 | 11/1960 | Poehler | 84/454 |
| 3,861,266 | 1/1975 | Whitaker | 84/454 |
| 3,968,719 | 7/1976 | Sanderson | 84/454 |
| 4,014,242 | 3/1977 | Sanderson | 84/454 |
| 4,088,052 | 5/1978 | Hedrick | 84/454 |
| 4,120,229 | 10/1978 | Ota | 84/454 |
| 4,281,577 | 8/1981 | Middleton | 84/454 |
| 4,429,609 | 2/1984 | Warrender | 84/454 |
| 5,245,313 | 9/1993 | Polityka | 116/28.1 |

FOREIGN PATENT DOCUMENTS

| | | |
|---|---|---|
| 52-33573 | 3/1977 | Japan . |
| 59-5926(A) | 12/1984 | Japan . |
| 2-153393(A) | 6/1990 | Japan . |
| 2198874 | 6/1988 | United Kingdom . |

OTHER PUBLICATIONS

Ex Parte Gwinn, 112 USPQ 439 (1955).

*Primary Examiner*—Michael L. Gellner
*Assistant Examiner*—Cassandra C. Spyrou
*Attorney, Agent, or Firm*—Finnegan, Henderson, Farabow, Garrett & Dunner

[57] ABSTRACT

A chromatic tuner display comprises a base member, with a predetermined point on the base member corresponding to the precise pitch of a desired musical note. The display includes colored light means mounted on the base member for visually representing the pitch of a sound, including a plurality of illuminative letters ordered for corresponding to the notes of the musical scale, a plurality of additional illuminative characters positioned on the base member between adjacent letters for corresponding to sharp and flat variations of the lettered musical notes, and a plurality of colored light devices, the devices including a plurality of opposing pairs of ascending and descending light devices on opposite sides of the predetermined point, each opposing pair having specified color for visually indicating whether a musical sound is above or below the pitch of the musical note represented by an illuminated letter or letter and character combination, and for visually indicating the relative difference in pitch of the musical sound from the desired musical note.

11 Claims, 4 Drawing Sheets

CHROMATIC TUNER DISPLAY

This application is a continuation of application Ser. No. 07/966,391, filed Oct. 26, 1992, now abandoned.

BACKGROUND OF THE INVENTION

1. Field of the Invention

This invention relates to electronic tuning aids for use in tuning stringed musical instruments. More particularly, the invention relates to displays used on electronic tuning aids to provide a visual indication of necessary pitch adjustments to reach a desired musical note.

2. Description of the Related Art

Various types of electronic tuning aids have been disclosed in the prior art. For example, U.S. Pat. No. 2,958,250 describes a musical instrument tuning apparatus having a control panel with 12 black and white keys corresponding to the notes of the chromatic musical scale displayed thereon. In operation, a cathode ray tube compares the frequency of a string to a calibrated predetermined frequency. The cathode ray tube display is utilized to determine when the two frequencies are coincident. The black and white keys on the control panel are push buttons which correspond to the notes of the chromatic musical scale. A player sounds a note on the instrument and depresses the corresponding button of the apparatus. The pitch is then adjusted by watching the cathode ray tube display.

In U.S. Pat. No. 4,088,052, the pitch of a stringed instrument is compared with a known standard, and an output error signal is generated. An audio amplifier responsive to the output error signal drives a motor and gear train to automatically tension the string pin of the instrument until the error signal amplitude is reduced to a predetermined level.

U.S. Pat. No. 3,861,266 describes a musical tuning instrument utilizing digital techniques in which a visual display indicates whether a musical tone is higher or lower than a particular musical note. The actual tones are compared in frequency with reference frequencies and the comparison is indicated by a pattern on a light emitting diode display. The display consists of 16 LEDs formed in a circle. If a note sounded into a microphone is exactly 440 Hz, a stationary pattern of half the LEDs lit and the other half unlit will appear. If the note is low, the pattern on the display will rotate in one direction and if the note is high it will rotate in the opposite direction. The rate of rotation indicates how far off the note is from the reference signal.

In U.S. Pat. No. 3,968,719, a display unit consisting of pairs of opposed light emitting diodes is arranged in a circle. When a note is in tune, one pair of lamps may be at or nearly at full brilliance, or two pairs may be partially lit. If there is a frequency deviation, the individual lamp pairs reach full brilliance in one of two sequences. If the note is sharp, then the lamps reach full brilliance in a clockwise sequence so the display appears to rotate clockwise. When a note is flat the sequence is reversed and the display appears to rotate counter clockwise. The rate at which the display appears to rotate indicates the magnitude of the deviation from the desired note.

U.S. Pat. No. 4,429,609 discloses a pitch analyzer in which pitch information is converted into appropriate display driving signals which are directed to a visual display in the form of a treble clef.

All of these patents involve attempts at solving a problem of providing a rapid and efficient means for assisting a musician to tune a stringed musical instrument. Tuning of a stringed instrument needs to be accurate and simple so that inordinate amounts of time are not required. In addition, it is desirable for a tuner display to be compact and visually attractive. Ability to see the display in various light conditions and to quickly recognize the magnitude of pitch deviations is desirable.

Accordingly, it is an object of the present invention to provide an illuminated display for a chromatic tuner which is visually easy to interpret, and is compact.

It is a further object of the present invention to provide a chromatic tuner display which can show a large number of increments of pitch variation with a relatively small number of light devices.

It is an additional object of the invention to provide a chromatic tuner display which is color coded for rapid visual recognition, and which includes illuminated letters corresponding to the musical notes of a chromatic scale for easier use.

Additional objects and advantages of the invention will be apparent from the description which follows, or may be learned by practice of the invention.

SUMMARY OF THE INVENTION

To achieve the foregoing objects and advantages, and in accordance with the purposes of the invention as embodied and broadly described herein, the chromatic tuner display of the present invention comprises a base member, having a predetermined point thereon which corresponds to the precise pitch of the desired musical note. Colored light means are mounted on the base member for visually representing the pitch of a sound. The colored light means includes a plurality of illuminative letters ordered for corresponding to the notes of the musical scale. A plurality of additional illuminative characters are positioned on the base member between adjacent ones of the plurality of illuminative letters for corresponding to sharp and flat variations of the lettered musical notes. A plurality of colored light devices including a plurality of opposing pairs of ascending and descending light devices is disposed on opposite sides of the predetermined point. Each opposing pair may have a specified color for visually indicating whether a musical sound is above or below the pitch of the musical note represented by an illuminated letter or letter and character combination. The opposing pairs of ascending and descending light devices are also disposed for visually indicating the relative difference in pitch of the musical sound from the desired musical note.

As an option, the opposing pairs of ascending and descending light devices may have alternating shapes. It is preferred that the opposing pairs include at least red, yellow and green light devices. The colored light means may include at least one multiple opposing pair of light devices of the same color.

It is preferred that the colored light means also includes a central light device positioned at the predetermined point for illuminating when a musical sound corresponds to the precise pitch of a desired musical note represented by an illuminated letter or letter and character combination. The colored light means may include three opposing pairs of red devices, two opposing pairs of yellow devices and one opposing pair of green devices, the green devices being arranged adjacent to the central light device and the yellow and red devices being successively further from the central light device. A numerical scale may also be provided on the base member, each number of the scale corresponding to one of the light devices for indicating the relative difference in pitch of a musical sound from a desired musical note.

The illuminative letters and characters may be white, and the colored light devices may be adapted to be energized in successive sequences as the pitch of the musical sound becomes closer or farther from the desired note. Each sequence may include a single one of the colored light devices, followed by a pair of adjacent colored light devices and the other colored light device of the adjacent pair. This increases the number of increments of pitch variation which may be visually displayed, without the need for an excessive number of light devices.

BRIEF DESCRIPTION OF THE DRAWINGS

The accompanying drawings which are incorporated in and constitute a part of the specification, illustrate the presently preferred embodiments of the invention and, together with the description, serve to explain the principles of the invention.

DESCRIPTION OF THE PREFERRED EMBODIMENTS

Reference will now be made in detail to the present preferred embodiments of the invention, as illustrated in the accompanying drawings.

The present invention is a chromatic tuner display for use with an electronic tuning aid apparatus. In accordance with the invention, the chromatic tuner display comprises a base member, a predetermined point on the base member corresponding to the precise pitch of a desired musical note; and colored light means mounted on the base member for visually representing the pitch of a sound, including a plurality of illuminative letters ordered for corresponding to the notes of the musical scale, a plurality of additional illuminative characters positioned on the base member between adjacent letters for corresponding to sharp and flat variations of the lettered musical notes, and a plurality of colored light devices, the devices including a plurality of opposing pairs of ascending and descending light devices on opposite sides of a predetermined point. Each opposing pair may have a specified color for visually indicating whether a musical sound is above or below the pitch of the musical note represented by an illuminated letter or letter and character combination. The colored light means visually indicates the relative difference in pitch of the musical sound from the desired musical note.

Figure 1:
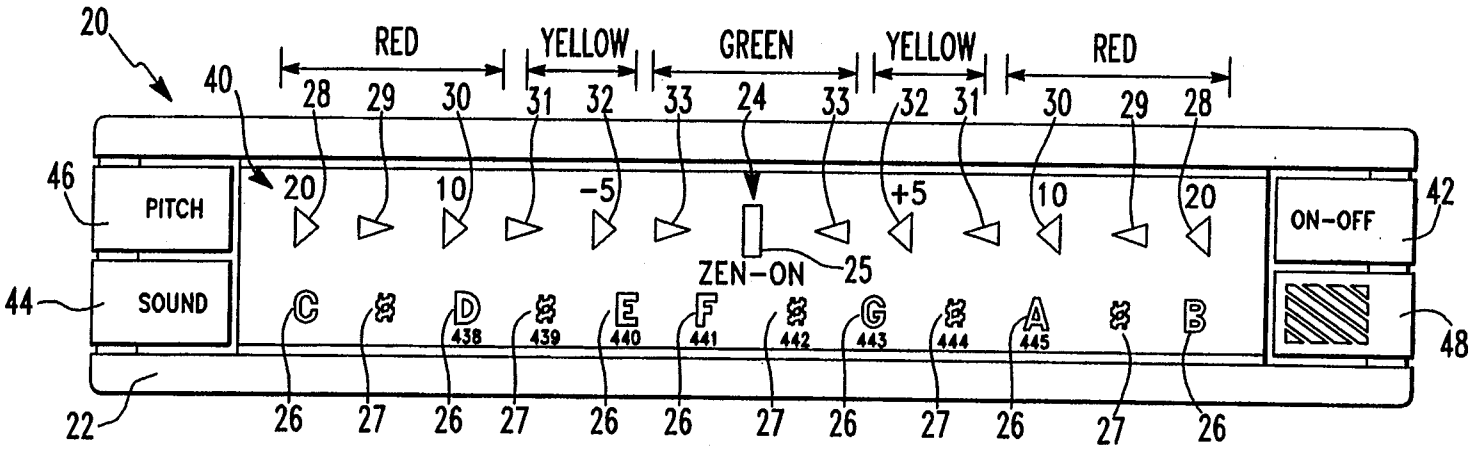
FIG. 1 is a front view of a chromatic tuner display of the present invention.

As shown in FIG. 1, the tuner display, generally designated by the numeral 20, includes a base member 22 for supporting the other components of the display. A predetermined point 24 on the base member corresponds to the precise pitch of a desired musical note. In the illustrated embodiment, the colored light means includes a plurality of illuminative letters 26 ordered for corresponding to the notes of the musical scale. A plurality of additional illuminative characters 27 are positioned on the base member 22 between adjacent letters 26 for corresponding to sharp and flat variations of the lettered musical notes. As shown in FIG. 1, a plurality of colored light devices 28, 29, 30, 32, 33 are arranged in opposing pairs of ascending and descending light devices on opposite sides of the predetermined point 24. Each opposing pair 28, 29, 30, 31, 32, 33 may have a specified color for visually indicating a relative difference in pitch above or below the pitch of the musical note represented by one of the illuminated letters 26 or a combination of letters 26 and characters 27. The particular arrangement of the colored light devices visually indicates the relative difference in pitch of the musical sound from the desired musical note. As shown in FIG. 1, the opposing pairs of ascending and descending light devices 28–33 may have alternating shapes for easier recognition. In addition, the opposing pairs may include at least red, yellow and green light devices, as shown by the labels in FIG. 1.

In the embodiment illustrated in FIG. 1, a central light device 25 is positioned at the predetermined point 24 for illuminating when a musical sound corresponds to the precise pitch of a desired musical note represented by an illuminated letter or letter and character combination.

As illustrated in FIG. 1, the display 20 may include three opposing pairs of red light devices, two opposing pairs of yellow light devices and one opposing pair of green light devices. The green devices 33 may be arranged adjacent to the central light device 25, and the yellow (31, 32) and red (28, 29, 30) devices may be successively further from the central light device 25. In addition, a numerical scale 40 may be arranged on the base member. Each number of the scale 40 corresponds to one of the light devices for indicating the relative difference in pitch of a musical sound from a desired musical note.

Typically, chromatic tuning devices indicate the variance from an exact pitch of a note in units of 100 "cents," with 0, indicating exact pitch, and a maximum error of ±50 cents. The numerical scale 40 provides a visual indication of the pitch variation by calibrating the tuner to correspond with the scale being used. Thus, information about the amount of pitch error in cents is accurately shown and may be easily recognized.

The base member may also act as a support for other control buttons of the chromatic tuner, such as an on-off button 42, a sound activation button 44, and a pitch activation button 46. In addition, an optional illuminated display 48 may be included to visually indicate when the tuner is turned on.

In operation, the chromatic tuner is turned on and automatically calibrated to 440 Hz. When a musical sound is received by the tuner, a note 26, corresponding to the sound detected, of the chromatic scale is illuminated either alone or with an adjacent character 27. The opposing pairs of light devices also illuminate to indicate the pitch variation of the sound from the precise pitch of the illuminated note 26. For example, a rapid flashing of the outermost red light device 28 may indicate that the pitch is ±35 to 50 cents from true pitch. A slower rate of flashing of the same light device could signify a ±25 to 35 cents. A constant light on the red light device 28 may signify ±20 to 25 cents pitch variation. A constant light on both of the light devices 28 and 29 may signify ±16 to 20 cents variation. The following table illustrates one possible arrangement of illumination which may be used to indicate pitch variation.

TABLE 1

| | |
|---|---|
| Green 25 | ±2 cents |
| Green 25 and Green 33 | ±2-3.5 |
| Green 33 and Yellow 32 | ±3.5-5 |
| Yellow 32 | ±5-6.5 |
| Yellow 32 and Yellow 31 | ±6.5-8 |
| Yellow 31 and Red 30 | ±8-10 |
| Red 30 | ±10-13 |
| Red 30 and Red 29 | ±13-16 |
| Red 29 and Red 28 | ±16-20 |
| Red 28 | ±20-25 |
| Red 28 (flashing slowly) | ±25-35 |
| Red 28 (flashing rapidly) | ±35-50 |

Chromatic tuners of the type described herein are generally in use, and the electronic and circuit elements of such devices are well known to those skilled in the art. Accordingly, a detailed discussion of the internal circuitry and electronic components of these types of devices is not set forth in this application. An example of a tuner of this general type having a display with both light devices and a meter device is one marketed under the trademark (CHROMATINA 331) by Zen-on Music Co., Ltd. of Tokyo, Japan. Another such chromatic tuner having an LED meter device is marketed under the name (DIGITAL TUNER DT-2) by Korg, Inc. of Tokyo, Japan. Circuitry such as that used in these commercially available tuners and others described above in the background section of this application would be suitable for operating the tuner display of the present invention, and is known to those skilled in the art. The construction of a tuner having the display of the present invention is believed to be well within the capability of those skilled in the art.

Based on the pitch variation shown by the illuminated light devices, the musician may adjust the tension of the particular string of the instrument. During this adjustment, the string may be replayed repeatedly so that the variation of pitch toward or away from the true pitch may be observed on the tuner display 20. The green center light 25 may remain flashing at a medium speed to serve as a reference point throughout the tuning process. In addition, the note B or another selected illuminative note or character may be designated to flash intermittently for indicating when the battery power is weak.

Figure 2:
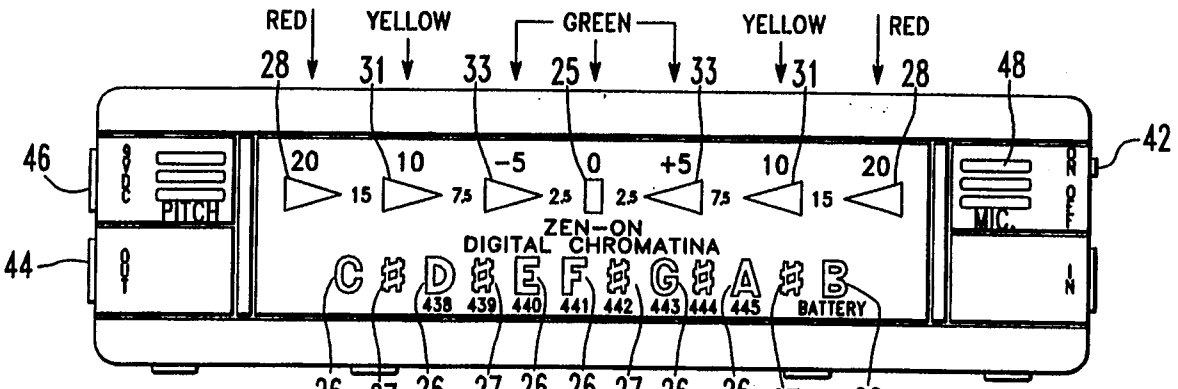
FIG. 2 is a front view of an alternative embodiment of the chromatic tuner display of the invention.

FIG. 2 illustrates another embodiment of the invention which is similar to the embodiment of FIG. 1. Like reference numerals have been used in FIG. 2 for similar elements to those in FIG. 1.

The embodiment of FIG. 2 is more compact than that of FIG. 1 in that fewer light devices are utilized. In FIG. 2, the illuminative letters and characters are the same as in FIG. 1. However, only three opposing pairs of light devices are provided for indicating the pitch variation. As shown in FIG. 2, opposing pairs of red, yellow and green light devices 28, 31 and 33 are provided. In addition, there is a central light device 25 as in the embodiment of FIG. 1. An example of an illumination pattern which may be used with the embodiment of FIG. 2 is set forth in the following table.

TABLE 2

| | |
|---|---|
| Two Green 33 + Center 25 | ±2 cents |
| One Green 33 + Center 25 | ±2-4 |

TABLE 2-continued

| | |
|---|---|
| One Green 33 | ±4-6 |
| Green 33 and Yellow 31 | ±6-9 |
| Yellow 31 | ±9-14 |
| Yellow 31 and Red 28 | ±14-19 |
| Red 28 | ±19-25 |
| Red 28 (slow flashing) | ±25-35 |
| Red 28 (rapid flashing) | ±35-50 |

The illumination of the letters and adjacent characters is the same as in the embodiment of FIG. 1.

Figure 3:
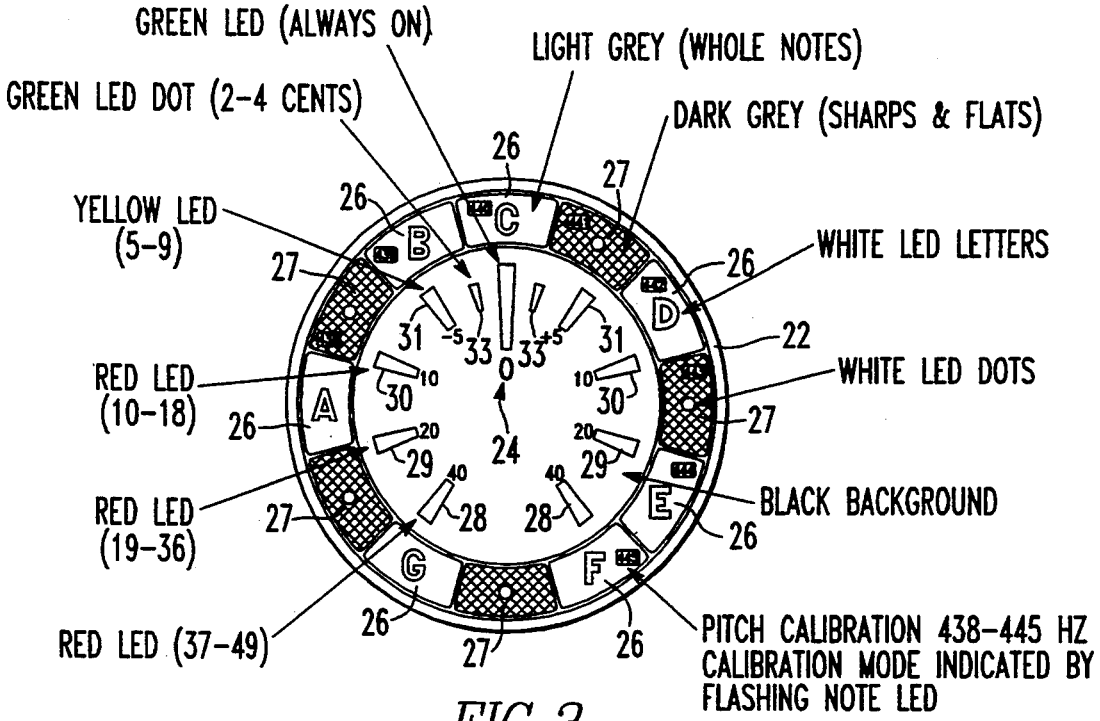
FIG. 3 is a front view of an alternative embodiment wherein the chromatic tuner display is circular in shape.

FIG. 3 shows an alternative embodiment in which the tuner display has a circular configuration. Like reference numerals are used in FIG. 3 for similar elements as in FIG. 1. The illuminative letters and characters are arranged in a circle on the perimeter of the base member 22. The light devices 28, 29, 30, 31 and 33 are also arranged in a circle concentric with and within the circle formed by the illuminative letters 26 and characters 27. The circular arrangement of pitch information concentrically within the chromatic note selection provides a very compact arrangement which accurately and quickly conveys pitch variation information to the user.

Figure 4:
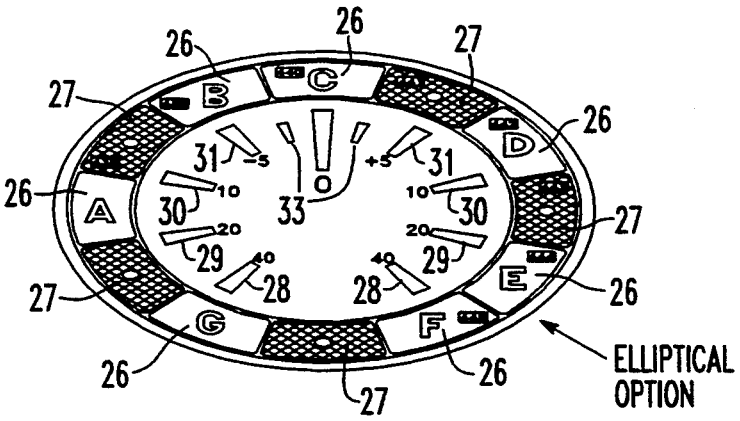
FIG. 4 shows another embodiment wherein the chromatic tuner display is elliptical in shape.

The embodiment shown in FIG. 4 is similar to that of FIG. 3 except that the base member is elliptical in shape. The illuminative letters and the light devices are concentrically arranged as in the embodiment of FIG. 3.

Figure 5:
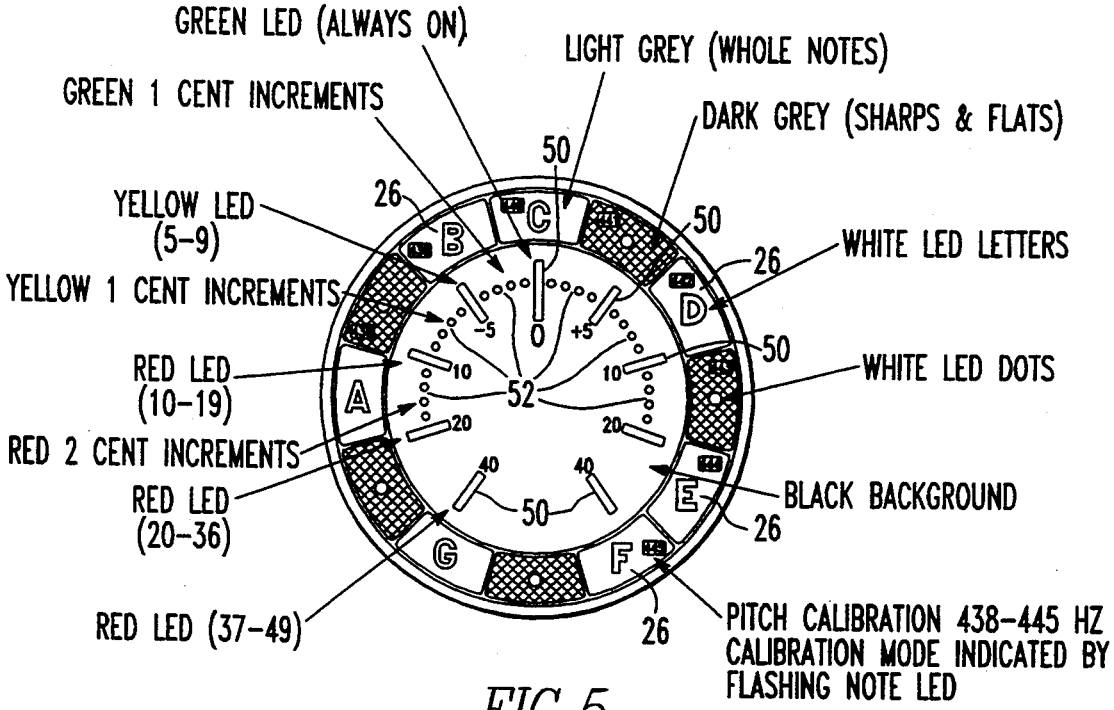
FIG. 5 is another embodiment of the chromatic tuner display which is circular in shape.
Figure 6:
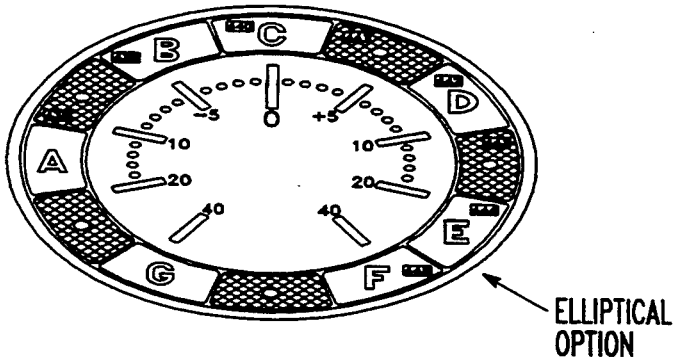
FIG. 6 is an alternative embodiment of the elliptical chromatic tuner display.

FIGS. 5 and 6 illustrate further embodiments which are very similar to those of FIGS. 3 and 4. In FIG. 5, the tuner display is circular, as in FIG. 3. However, the light devices are in the form of lines 50 and intervening dots 52. The larger number of dots provides a higher degree of accuracy in representing the pitch variation. FIG. 6 is similar to FIG. 5 in that the light devices are in the form of lines and dots.

Figure 7:
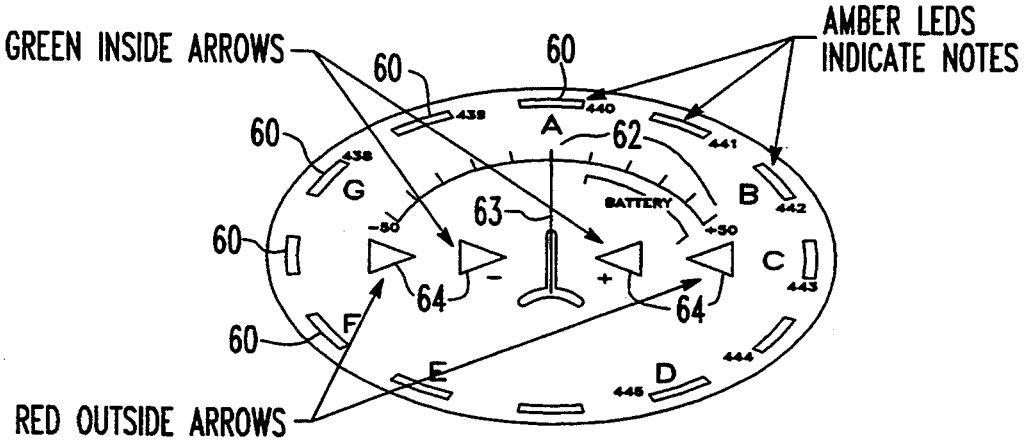
FIG. 7 is a further embodiment of a chromatic tuner display which may be used with an analog type meter.

FIG. 7 represents a display which could be used with an analog type tuner. A series of lights 60 is arranged around the perimeter of the display for representing the musical notes and sharp and flat variations thereof. The precise measurement of pitch variation is made using a meter type scale 62 with a moveable dial 63. However, two opposing pairs of light devices 64 are also included for representing visually the magnitude of the pitch variation. This display is particularly useful in connection with an analog tuning mechanism.

The structure of the present invention, which is compact and easy to operate, allows for rapid recognition of pitch variations and easier tuning of stringed instruments. The associative meaning of the colors provides a very quick reference for the user. By displaying graphically and illuminatively the interval relationships between the notes, the display of the present invention provides a marked improvement over the prior art.

Additional advantages and modifications will readily occur to those skilled in the art. The invention in its broader aspects is therefore not limited to the specific details, representative apparatus and illustrative examples shown and described. Accordingly, departures may be made from such details without departing from the spirit or scope of the general inventive concept defined by the appended claims and their equivalence.

What is claimed is:

1. A chromatic tuner display for indicating a relative difference between a pitch of a sound and a pitch of a desired note of a musical scale, the display comprising:

a base member having a predetermined point located thereon corresponding to the pitch of the desired note;

a plurality of translucent elements mounted on the base member including a plurality of letters corresponding to notes of the musical scale, a plurality of characters corresponding to sharp and flat variations of the notes represented by the letters, and a plurality of indicators, each of the indicators having a specified color, the specified color of one of the indicators being different from the specified color of at least another of the indicators, each of the specified colors corresponding to a different predetermined difference in pitch between the sound and the desired note; and means for selectively illuminating the letters, characters, and indicators to visually represent the pitch of the sound and the desired note, the illuminating means illuminating one of the letters or a combination of one of the letters and one of the characters to represent the desired note, the illuminating means also illuminating at least one of the indicators to indicate the relative difference in the pitch of the sound from the pitch of the desired note;

the illuminating means illuminating the indicators in the following sequence as the pitch of the sound changes for increasing the number of increments of pitch variation which may be visually displayed: a first one of the indicators; the first one of the indicators and a second one of the indicators adjacent the first indicator; the second indicator.

2. The display of claim 1, wherein each of the indicators has a specified shape, the specified shade of one of the indicators being different from the specified shape of at least another of the indicators.

3. The display of claim 2, wherein each of the indicators is mounted on the base member at a specified distance from the predetermined point, the specified distance from the predetermined point of one of the indicators being different from the specified distance from the predetermined point of at least another of the indicators, each of the specified distances corresponding to a different predetermined difference in pitch between the sound and the desired note.

4. The display of claim 1, wherein the indicators are arranged on the base member in pairs, each of the pairs including a first indicator mounted on one side of the predetermined point and a second indicator mounted on the opposite side of the predetermined point, the first and second indicators being of the same specified color.

5. The display of claim 4, wherein the pairs of indicators include one pair of red indicators, one pair of yellow indicators, and one pair of green indicators.

6. The display of claim 5, wherein the pairs of indicators include at least two pairs of indicators of the same color.

7. The display of claim 1, wherein the translucent elements also include a central indicator positioned at the predetermined point, the illuminating means illuminating the central indicator when the pitch of the sound corresponds to the pitch of the desired note.

8. The display of claim 7, wherein the pairs of indicators include one pair of red indicators, one pair of yellow indicators, and one pair of green indicators.

9. The display of claim 7, wherein the pairs of indicators include three pairs of red indicators, two pairs of yellow indicators, and one pair of green indicators, the green indicators being arranged adjacent to the central indicator, and the yellow and red indicators being successively further from the central indicator.

10. The display of claim 9, further including a numerical scale on the base member having a plurality of numbers, each of the numbers of the scale corresponding to one of the indicators for indicating the relative difference in pitch of the sound from the pitch of the desired note.

11. The display of claim 7, wherein the letters and characters are white.

* * * * *

UNITED STATES PATENT AND TRADEMARK OFFICE

CERTIFICATE OF CORRECTION

PATENT NO. : 5,427,011

DATED : June 27, 1995

INVENTOR(S) : Steinberger

It is certified that error appears in the above-indentified patent and that said Letters Patent is hereby corrected as shown below:

Claim 2, col. 7, line 30, "shade" should read --shape--.

Signed and Sealed this

Nineteenth Day of September, 1995

*Attest:*

Bruce Lehman

BRUCE LEHMAN

*Attesting Officer*

*Commissioner of Patents and Trademarks*